US009306291B2

(12) United States Patent
Lu et al.

(10) Patent No.: US 9,306,291 B2
(45) Date of Patent: Apr. 5, 2016

(54) MOBILE DEVICE AND ANTENNA ARRAY THEREIN

(71) Applicant: HTC Corporation, Taoyuan, Taoyuan County (TW)

(72) Inventors: Yu-Chun Lu, Taipei (TW); Yi-Cheng Lin, Taipei (TW); Pei-Zong Rao, Taoyuan (TW); Wei-Shin Tung, Taoyuan (TW)

(73) Assignee: HTC Corporation, Taoyuan (TW)

( * ) Notice: Subject to any disclaimer, the term of this patent is extended or adjusted under 35 U.S.C. 154(b) by 383 days.

(21) Appl. No.: 13/852,301

(22) Filed: Mar. 28, 2013

(65) Prior Publication Data

US 2013/0257672 A1 Oct. 3, 2013

Related U.S. Application Data

(63) Continuation-in-part of application No. 13/435,867, filed on Mar. 30, 2012, now Pat. No. 8,760,352.

(51) Int. Cl.

| | |
|---|---|
| ***H01Q 21/00*** | (2006.01) |
| ***H01Q 1/52*** | (2006.01) |
| ***H01Q 21/06*** | (2006.01) |

(Continued)

(52) U.S. Cl.

CPC ..... *H01Q 21/00* (2013.01); *H01Q 1/525* (2013.01); *H01Q 21/06* (2013.01); *H01Q 1/40* (2013.01); *H01Q 13/18* (2013.01)

(58) Field of Classification Search

CPC ..... H01Q 1/40; H01Q 13/18; H01Q 21/00; H01Q 21/06; H01Q 1/525; H01Q 3/00

See application file for complete search history.

(56) References Cited

U.S. PATENT DOCUMENTS

| | | | |
|---|---|---|---|
| 4,975,711 | A | 12/1990 | Lee |
| 5,608,413 | A | 3/1997 | Macdonald |
| 6,456,242 | B1 | 9/2002 | Crawford |

(Continued)

FOREIGN PATENT DOCUMENTS

| | | | |
|---|---|---|---|
| CN | 1497775 | A | 5/2004 |
| CN | 101471711 | A | 7/2009 |

(Continued)

OTHER PUBLICATIONS

Ariza et al., "Dual-polarized architecture for channel sounding at 60 GHz with digital/analog phase control based on 0.25μm SiGe BiCMOS and LTCC technology" , in Antennas and Propagation (EUCAP), Proceedings of the 5th European Conference on (Apr. 11-15, 2011), pp. 1454-1458.

(Continued)

*Primary Examiner* — Hoang V Nguyen
*Assistant Examiner* — Michael Bouizza
(74) *Attorney, Agent, or Firm* — Birch, Stewart, Kolasch & Birch, LLP

(57) ABSTRACT

A mobile device at least includes a dielectric substrate, an antenna array, and a transceiver. The antenna array at least includes a first antenna and a second antenna. The first and second antennas are both embedded in the dielectric substrate. The first and second antennas have different polarizations. The transceiver is coupled to the antenna array so as to transmit or receive a signal. The polarization of the antenna array may be dynamically adjusted by controlling a phase difference between the first antenna and the second antenna.

14 Claims, 18 Drawing Sheets

(51) Int. Cl.
*H01Q 1/40* (2006.01)
*H01Q 13/18* (2006.01)

(56) References Cited

U.S. PATENT DOCUMENTS

| | | | | |
|---|---|---|---|---|
| 6,507,322 | B2 | 1/2003 | Fang et al. | |
| 7,034,762 | B2 | 4/2006 | Huang | |
| 7,471,251 | B2 | 12/2008 | Kawasaki et al. | |
| 8,350,771 | B1 * | 1/2013 | Zaghloul et al. | 343/769 |
| 2004/0070543 | A1 | 4/2004 | Masaki | |
| 2005/0146475 | A1 | 7/2005 | Bettner et al. | |
| 2006/0125575 | A1 * | 6/2006 | Kim et al. | 333/134 |
| 2009/0143038 | A1 | 6/2009 | Saito | |
| 2011/0181482 | A1 | 7/2011 | Adams et al. | |
| 2011/0248891 | A1 | 10/2011 | Han et al. | |
| 2013/0257668 | A1 | 10/2013 | Rao et al. | |

FOREIGN PATENT DOCUMENTS

| | | | |
|---|---|---|---|
| CN | 101982898 | A | 3/2011 |
| CN | 102394368 | A | 3/2012 |
| DE | 10 2013 204 368 | A1 | 10/2013 |
| EP | 1 168 658 | A1 | 1/2002 |
| EP | 1 411 587 | A1 | 4/2004 |
| TW | 201136020 | A1 | 10/2011 |
| WO | WO 98/37590 | A2 | 8/1998 |
| WO | WO 03/017425 | A1 | 2/2003 |

OTHER PUBLICATIONS

Wollenschläger et al., "A compact dual-polarized wideband patch antenna array for the unlicensed 60 GHz band" , in Antennas and Propagation (EUCAP), Proceedings of the 5th European Conference on (Apr. 11-15, 2011), pp. 1873-1877.
"Layout Engineer (f/m), Villach / Austria", Lantiq, http://www.lantiq.com/fileadmin/media/careers/austria/LQAT-VIL-005 LayoutEngineer 1112.pdf, 2 pages.
"Wege zur Haus- und Heimvernetzung", AG2 Projektgruppe Haus- und Heimvernetzung, http://www.lantiq.com/fileadmin/downloads/AG2, Nationaler ITGipfel, HausHeimvernetzung s6.pdf, 2011, pp. 1-20.
Brebels et al., "3D System-in-Package Integration of 60 GHz Aperture-Coupled Micromachined Microstrip Antennas", IEEE, May 2010, pp. 1028-1031.
Daniels et al., "60 GHz Wireless: Up Close and Personal", IEEE Microwave Magazine, Dec. 2010 supplement, pp. S44-S50.
German Office Action dated May 6, 2014 for Application No. 10 2013 205 595.1 including a partial English translation.
Gilbert et al., "A 4-GBPS Uncompressed Wireless HD A/V Transceiver Chipset", IEEE Computer Society, 2008, pp. 56-64.
Guo et al., "Broadband 60-GHz Beam-Steering Vertical Off-Center Dipole Antennas in LTCC", IEEE, 2012, pp. 177-180.
Karim et al., "SiP-based 60GHz 4×4 Antenna Array with 90nm CMOS OOK Modulator in LTCC", IEEE, May 2010, pp. 352-355.
Kuo et al., "60-GHz Four-Element Phased-Array Transmit/Receive System-in-Package Using Phase Compensation Techniques in 65-nm Flip-Chip CMOS Process", IEEE Transactions on Microwave Theory and Techniques, vol. 60, No. 3, Mar. 2012, pp. 743-756.
Kuo et al., "A Fully SiP Integrated V-Band Butler Matrix End-Fire Beam-Switching Transmitter Using Flip-Chip Assembled CMOS on LTCC", IEEE Transactions on Microwave Theory and Techniques, vol. 60, No. 5, May 2012, pp. 1424-1436.
Lamminen et al., "Wideband Millimetre Wave End-Fire Antenna and Array for Wireless Short-Range Applications", Apr. 2010, 6 pages.
Lu et al., "Embedded End-Fire Monopole Antenna in Low Temperature Cofired Ceramic for 60 GHz", IEEE, 2013, pp. 326-327.
Merritt, "60 GHz Groups Face Off in Beijing over Wi-Fi's Future", EE Times, www.eetimes.com/document.asp?doc id=1256332, May 18, 2010, 2 pages.
Niknejad, "Siliconization of 60 GHz", IEEE Microwave Magazine, Feb. 2010, pp. 78-85.
Rappaport et al., "State of the Art in 60-GHz Integrated Circuits and Systems for Wireless Communications", Proceedings of the IEEE, vol. 99, No. 8, Aug. 2011, pp. 1390-1436.
Silicon Image, "Silicon Image Unveils Third-Generation WirelessHD 60GHz Chipsets", Silicon Image, Inc., May 30, 2011, 2 pages.
Suga et al., "A Small Package With 46-dB Isolation Between Tx and Rx Antennas Suitable for 60-GHz WPAN Module", IEEE Transactions on Microwave Theory and Techniques, vol. 60, No. 3, Mar. 2012, pp. 640-646.
Suga et al., "Cost-Effective 60-GHz Antenna Package With End-Fire Radiation for Wireless File-Transfer System", IEEE Transactions on Microwave Theory and Techniques, vol. 58, No. 12, Dec. 2010, pp. 3989-3995.
Suga et al., "Millimeter-wave Antenna with High-Isolation using Slab Waveguide for WPAN Applications", Proceedings of the 41st European Microwave Conference, Oct. 10-13, 2011, pp. 543-546.
Valdes-Garcia et al., "A Fully Integrated 16-Element Phased-Array Transmitter in SiGe BiCMOS for 60-GHz Communications", IEEE Journal of Solid-State Circuits, vol. 45, No. 12, Dec. 2010, pp. 2757-2773.
Yang et al., "Millimeter-Wave Antennas on a LTCC", IEEE, 2012, 2 pages.
Highly Integrated 60 GHz Radio Transceiver Chipset, published on Jul. 12,2012; Microwave Journal; Hittite Microwave Corp. Chelmsford, MA; pp. 1-6.
HMC6000LP711E, Millimeterwave Transmitter 57-64 GHz; Hittite; Microwave Corporation v00.1112; pp. 1-18.

* cited by examiner

MOBILE DEVICE AND ANTENNA ARRAY THEREIN

CROSS REFERENCE TO RELATED APPLICATIONS

This application is a Continuation-In-Part of application Ser. No. 13/435,867, filed on Mar. 30, 2012, the entirety of which is incorporated by reference herein.

BACKGROUND OF THE INVENTION

1. Field of the Invention

The subject application generally relates to a mobile device, and more particularly, relates to a mobile device comprising an antenna array.

2. Description of the Related Art

With the progress of mobile communication technology, a camera or video recorder in a mobile device can retrieve high-resolution images and videos. Some high-end mobile devices use HDMI (High-Definition Multimedia Interface) cables as an interface to transmit high-resolution audio/video data to other display devices. However, it is more convenient for people to use wireless transmission, in particular, a 60 GHz band which has sufficient bandwidth, for transmitting high-quality video data.

Traditionally, an antenna array for transmitting data usually occupies a lot of space in a mobile device. Furthermore, when the mobile device is moved or rotated, the antenna array cannot dynamically receive and transmit signals at different directions. This decreases communication quality of the mobile device.

BRIEF SUMMARY OF THE INVENTION

In one exemplary embodiment, the subject application is directed to a mobile device, at least comprising: a dielectric substrate; an antenna array, at least comprising: a first antenna, embedded in the dielectric substrate; and a second antenna, embedded in the dielectric substrate, wherein the first antenna and the second antenna have different polarizations; and a transceiver, coupled to the antenna array, and configured to transmit or receive a signal.

BRIEF DESCRIPTION OF DRAWINGS

The subject application can be more fully understood by reading the subsequent detailed description and examples with references made to the accompanying drawings, wherein.

DETAILED DESCRIPTION OF THE INVENTION

Figure 1A:
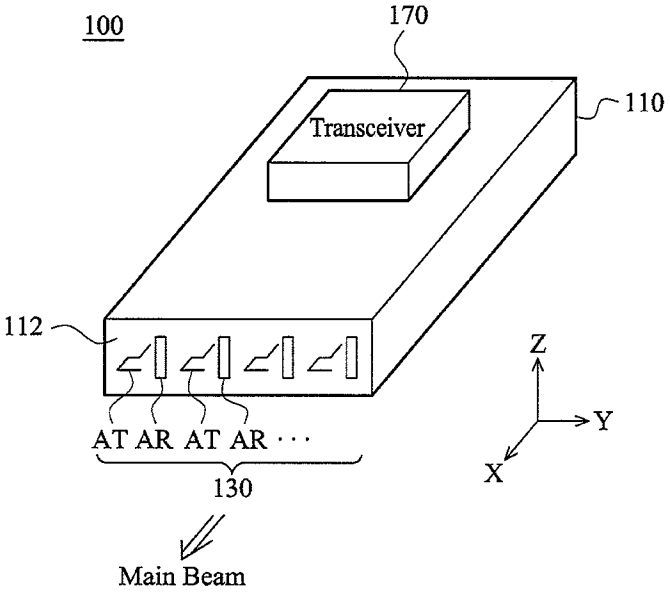
FIG. 1A is a pictorial drawing for illustrating a mobile device according to an embodiment of the invention.

FIG. 1A is a pictorial drawing for illustrating a mobile device 100 according to an embodiment of the invention. The mobile device 100 may be a smart phone, a tablet, or a notebook. As shown in FIG. 1A, the mobile device 100 at least comprises a dielectric substrate 110, an antenna array 130, and a transceiver 170. A skilled person in the art can comprehend that the mobile device 100 may further comprise a processor, a display module, a touch module, an input module, and other electronic components even if they are not shown in FIG. 1A. In some embodiments, the dielectric substrate 110 is an FR4 substrate or an LTCC (Low Temperature Co-fired Ceramics) substrate, and the transceiver 170 is a TR (Transmission and Reception) chip, which may be disposed on two sides of the dielectric substrate 110. The transceiver 170 is electrically coupled to the antenna array 130, and is configured to transmit or receive a signal.

The antenna array 130 is close to a lateral edge 112 of the dielectric substrate 110 so as to generate end-fire radiation, for example, substantially toward an X-direction in FIG. 1A. In an embodiment, the transceiver 170 is configured to adjust a main beam of the antenna array 130 toward a specific direction, which may be a reception direction of other display device interfaces (e.g., a monitor, a television, a projector, or a mobile device). The antenna array 130 comprises one or more transmission antennas AT for transmitting signals and one or more reception antennas AR for receiving signals. Since the transmission antennas AT are interleaved with the reception antennas AR, the isolation between the transmission antennas AT and/or the isolation between the reception antennas AR can be improved. In addition, all of the transmission antennas AT and the reception antennas AR of the antenna array 130 are embedded in the dielectric substrate 110, and the surface of the dielectric substrate 110 has sufficient space to accommodate other components, such as a TR chip. In an embodiment, the reception antennas AR and/or the transmission antennas AT are slot antennas, monopole antennas, dipole antennas, or Yagi antennas.

Figure 1B:
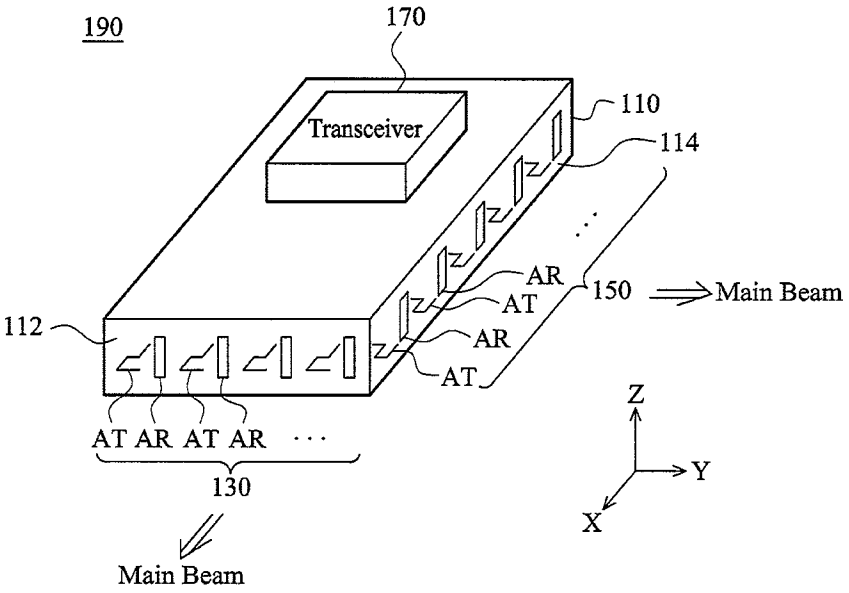
FIG. 1B is a pictorial drawing for illustrating a mobile device according to another embodiment of the invention.

FIG. 1B is a pictorial drawing for illustrating a mobile device 190 according to another embodiment of the invention. As shown in FIG. 1B, the mobile device 190 further comprises another antenna array 150 close to another lateral edge 114 of the dielectric substrate 110 so as to generate end-fire radiation, wherein the lateral edge 114 is substantially perpendicular to the lateral edge 112. In the embodiment, the main beam of the antenna array 130 is substantially toward the X-direction, and the main beam of the antenna array 150 is substantially toward a Y-direction. Similarly, the transceiver 170 is configured to dynamically adjust the main beams of the antenna arrays 130 and 150 toward a specific direction parallel to a reception direction of another display device interface.

Figure 2:
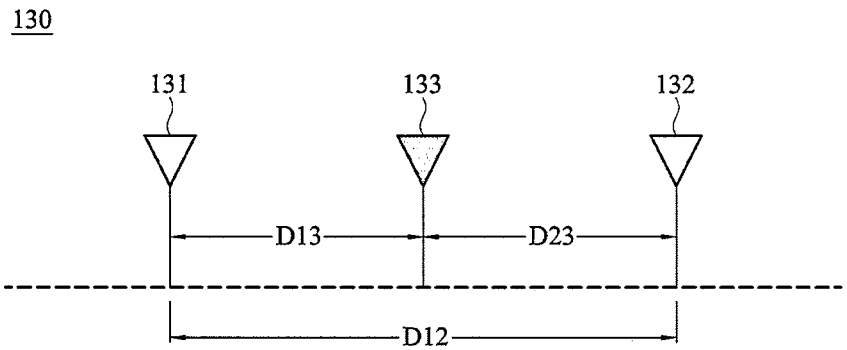
FIG. 2 is a diagram for illustrating an antenna array according to an embodiment of the invention.

FIG. 2 is a diagram for illustrating the antenna array 130 (or 150) according to an embodiment of the invention. As shown in FIG. 2, the antenna array 130 (or 150) comprises at least three antennas 131, 132 and 133. The antenna 133 is positioned between the antennas 131 and 132 so as to reduce coupling between the antennas 131 and 132. Note that the two adjacent antennas should be of different types to improve isolation. In an embodiment, each of the antennas 131 and 132 is a transmission antenna AT, and the antenna 133 is a reception antenna AR. In another embodiment, each of the antennas 131 and 132 is a reception antenna AR, and the antenna 133 is a transmission antenna AT. Note that since the antennas 131 and 132 are of the same type, a synthetic beam is formed by switching and adjusting the transceiver 170, and further by altering input phase and input energy of the antenna 131 and 132 so as to dynamically adjust the main beams of the antenna arrays 130 and 150. Therefore, other display device interfaces can have the optimal transmission and reception quality to increase the efficiency of wireless transmission. In a preferred embodiment, the antennas 131, 132 and 133 are all embedded in the dielectric substrate 110 and are substantially arranged in a straight line. The distance D12 between the antennas 131 and 132 is approximately a half wavelength ($\lambda/2$) of a central operating frequency of the antenna array 130. In another embodiment, the distance D13 between the antennas 131 and 133 is approximately equal to the distance D23 between the antennas 132 and 133. The antenna array 130 (or 150) may comprise more transmission antennas AT and more reception antennas AR as shown in FIG. 1A.

Figure 3A:
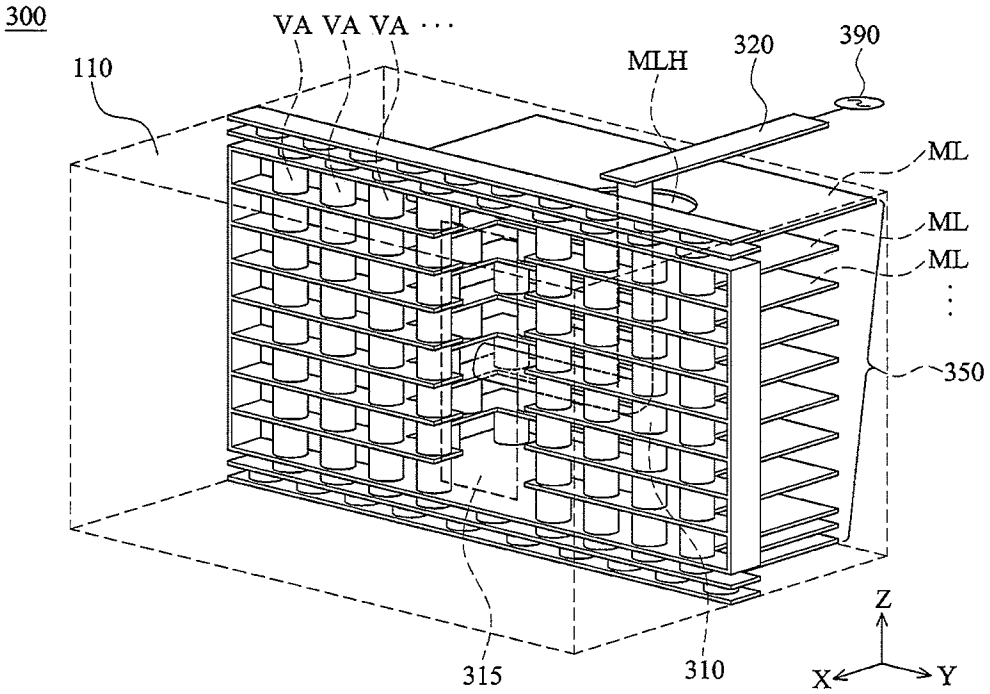
FIG. 3A is a pictorial drawing for illustrating a slot antenna according to an embodiment of the invention.
Figure 3B:
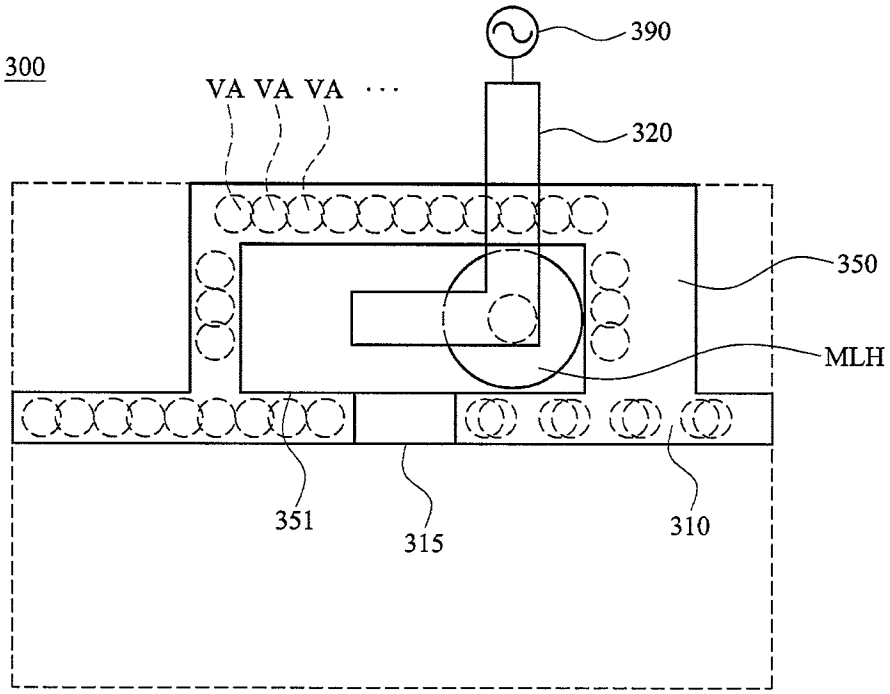
FIG. 3B is a vertical view for illustrating the slot antenna according to the embodiment of the invention.

FIG. 3A is a pictorial drawing for illustrating a slot antenna 300 according to an embodiment of the invention. FIG. 3B is a vertical view for illustrating the slot antenna 300 according to the embodiment of the invention. In a preferred embodiment, each reception antenna AR in the antenna array 130 (or 150) is a slot antenna 300 embedded in the dielectric substrate 110. As shown in FIGS. 3A and 3B, the slot antenna 300 comprises a ground structure 310, a feeding element 320, and a cavity structure 350. The ground structure 310, the feeding element 320 and the cavity structure 350 are all made of metal, such as aluminum or copper. The ground structure 310 is substantially flat and has a slot 315, which is parallel to the ground structure 310. The feeding element 320 is electrically coupled to a signal source 390 and extends across the slot 315 of the ground structure 310 such that the slot antenna 300 is excited. The cavity structure 350 is substantially a hollow metal housing and is electrically coupled to the ground structure 310. An open side 351 of the cavity structure 350 faces the slot 315 of the ground structure 310. The cavity structure 350 is configured to reflect electromagnetic waves to enhance the gain of the slot antenna 300. In other embodiments, the cavity structure 350 is removed from the slot antenna 300. In a preferred embodiment, the dielectric substrate 110 is an LTCC substrate which comprises a plurality of metal layers ML and a plurality of vias VA, and the ground structure 310 and the cavity structure 350 are formed by some of the plurality of metal layers ML and some of the plurality of vias VA. The plurality of vias are electrically coupled between the plurality of metal layers ML. In order to avoid leakage waves, the distance between any two adjacent vias VA should be smaller than 0.125 wavelength ($\lambda/8$) of a central operating frequency of the antenna array 130. The feeding element 320 may further extend through a circular hole MLH in the top metal layer ML into an interior of the cavity structure 350. In an embodiment, the feeding element 320 comprises a microstrip line or a stripline.

Figure 4:
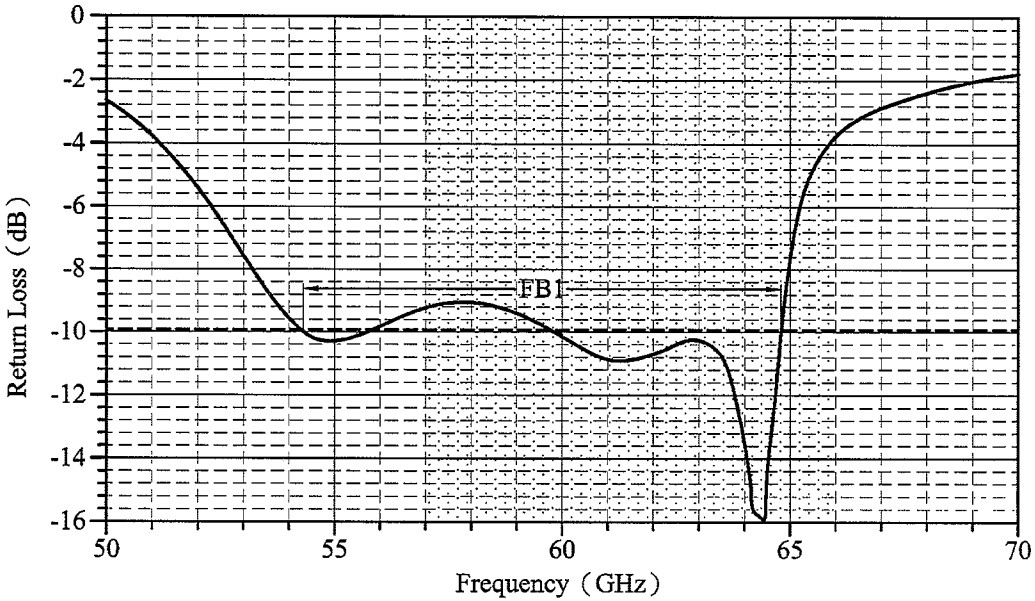
FIG. 4 is a diagram for illustrating return loss of the slot antenna according to an embodiment of the invention.

FIG. 4 is a diagram for illustrating return loss of the slot antenna 300 according to an embodiment of the invention. The vertical axis represents return loss (unit: dB), and the horizontal axis represents operating frequency (unit: GHz). As shown in FIG. 4, the slot antenna 300 is excited to form a frequency band PE 1 which is approximately from 57 GHz to 66 GHz. Therefore, the slot antenna 300 is capable of covering the 60 GHz band.

Figure 5A:
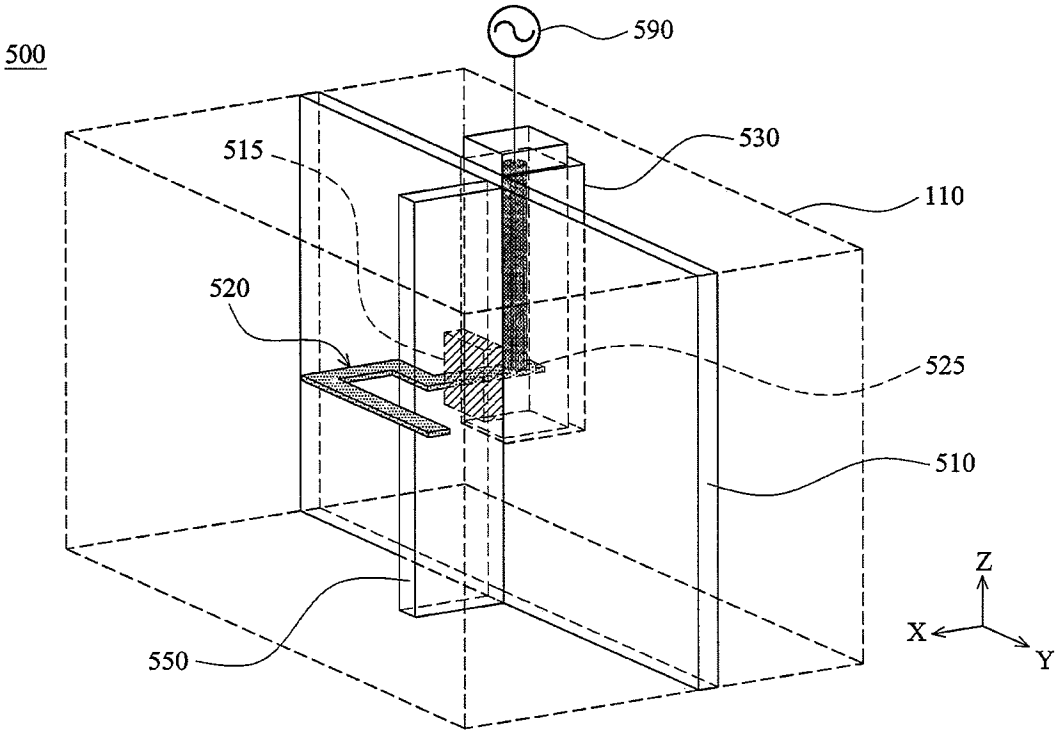
FIG. 5A is a pictorial drawing for illustrating a monopole antenna according to an embodiment of the invention.
Figure 5B:
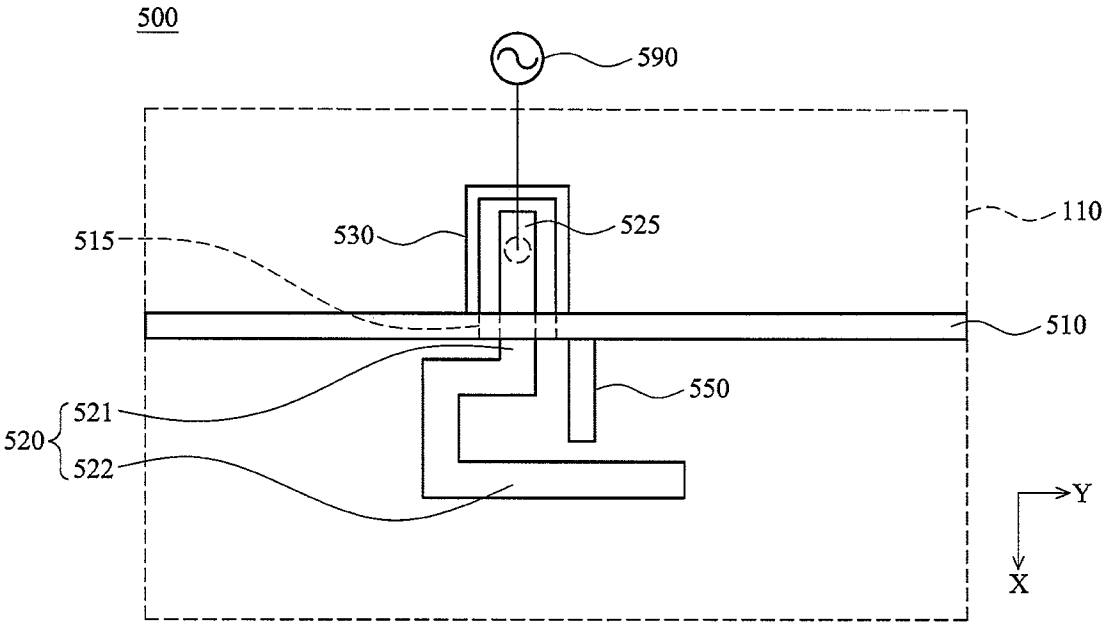
FIG. 5B is a vertical view for illustrating the monopole antenna according to the embodiment of the invention.

FIG. 5A is a pictorial drawing for illustrating a monopole antenna 500 according to an embodiment of the invention. FIG. 5B is a vertical view for illustrating the monopole antenna 500 according to the embodiment of the invention. In a preferred embodiment, each transmission antenna AT in the antenna array 130 (or 150) is a monopole antenna 500 embedded in the dielectric substrate 110, and extends in a direction perpendicular to the dielectric substrate 110 (e.g., the X-direction). As shown in FIGS. 5A and 5B, the monopole antenna 500 comprises a ground structure 510, a main radiation element 520, a feeding element 530, and a reflection structure 550 that are all made of metal, such as aluminum or copper. The ground structure 510 is substantially flat and has a small hole 515. One end 525 of the main radiation element 520 extends through the small hole 515 of the ground structure 510 perpendicularly. In an embodiment, the main radiation element 520 comprises two radiation sub-elements, an I-shaped radiation sub-element 521 and a J-shaped radiation sub-element 522. The I-shaped radiation sub-element 521 extends through the small hole 515 of the ground structure 510, and the J-shaped radiation sub-element 522 is electrically coupled to one end of the I-shaped radiation sub-element 521. In other embodiments, the main radiation element 520 has other shapes, such as an I-shape, a C-shape, or a Z-shape. The feeding element 530 is electrically coupled to the end 525 of the main radiation element 520, and is further electrically coupled to a signal source 590. In an embodiment, the feeding element 530 comprises a rectangular coaxial cable which is substantially parallel to the ground structure 510 and substantially perpendicular to the main radiation element 520. The reflection structure 550 is substantially flat. The reflection structure 550 is electrically coupled to the ground structure 510 and substantially perpendicular to the ground structure 510. The reflection structure 550 is close to the main radiation element 520 so as to reflect electromagnetic waves and adjust the radiation pattern of the monopole antenna 500. In other embodiments, the reflection 550 is removed from the monopole antenna 500. Similarly, in a preferred embodiment, the dielectric substrate 110 is an LTCC substrate which comprises a plurality of metal layers and a plurality of vias. Although not shown in FIGS. 5A and 5B, the ground structure 510 and the reflection 550 may be formed by some of the plurality of metal layers and some of the plurality of vias. Note that if the slot antenna 300 is adjacent to the monopole antenna 500, the ground structure 310 in FIG. 3A is electrically coupled to the ground structure 510 in FIG. 5A.

Figure 6:
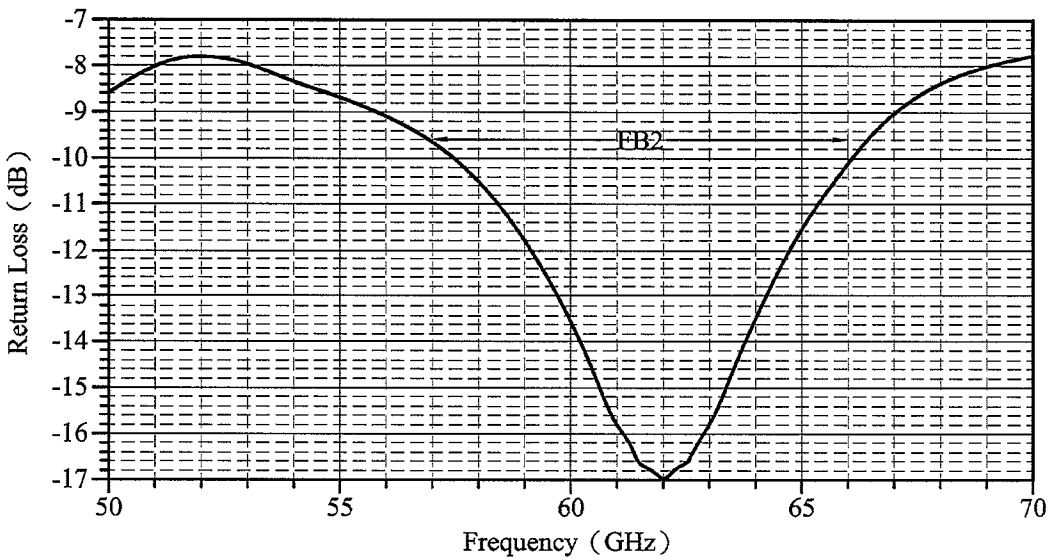
FIG. 6 is a diagram for illustrating return loss of the monopole antenna according to an embodiment of the invention.

FIG. 6 is a diagram for illustrating return loss of the monopole antenna 500 according to an embodiment of the invention. The vertical axis represents return loss (unit: dB), and the horizontal axis represents operating frequency (unit: GHz). As shown in FIG. 6, the monopole antenna 500 is excited to form a frequency band FB2 which is approximately from 57 GHz to 66 GHz. Therefore, the monopole antenna 500 is capable of covering the 60 GHz band. According to FIGS. 4 and 6, the antenna array 130 (or 150) is capable of covering an array band which is approximately from 57 GHz to 66 GHz.

Figure 7:
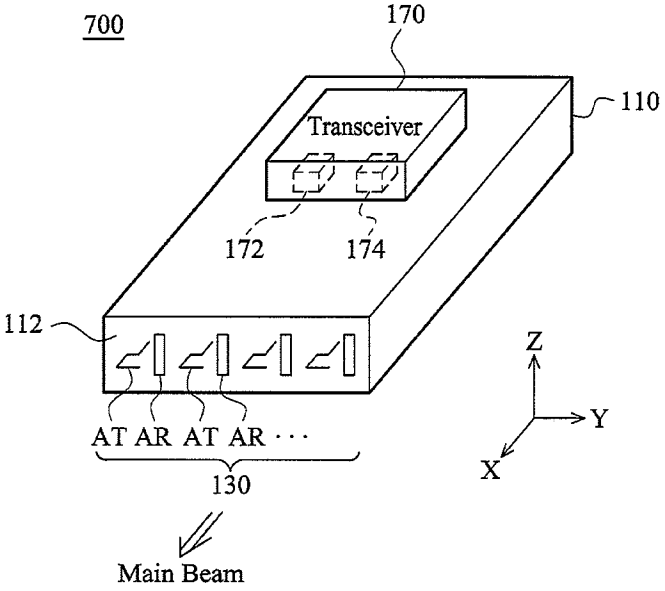
FIG. 7 is a pictorial drawing for illustrating a mobile device according to an embodiment of the invention.

FIG. 7 is a pictorial drawing for illustrating a mobile device 700 according to an embodiment of the invention. As shown in FIG. 7, a transceiver 170 of the mobile device 700 comprises a TR (Transmission and Reception) switch 172 and a tuner 174. In the embodiment, the transceiver 170 is disposed on the dielectric substrate 110, but it is not limited thereto. The TR switch 172 is configured to exchange the functions of the transmission antenna AT and the reception antenna AR. In other words, the transmission antenna AT can receive signals, and the reception antenna AR can transmit signals. The tuner 174 is configured to dynamically adjust the main beam of the antenna array 130 toward a specific direction (e.g., toward a reception direction of other display device interfaces). The TR switch 172 and the tuner 174 may be a portion of circuits in a TR chip. In other embodiments, the TR switch 172 is independent of the transceiver 170.

Figure 8:
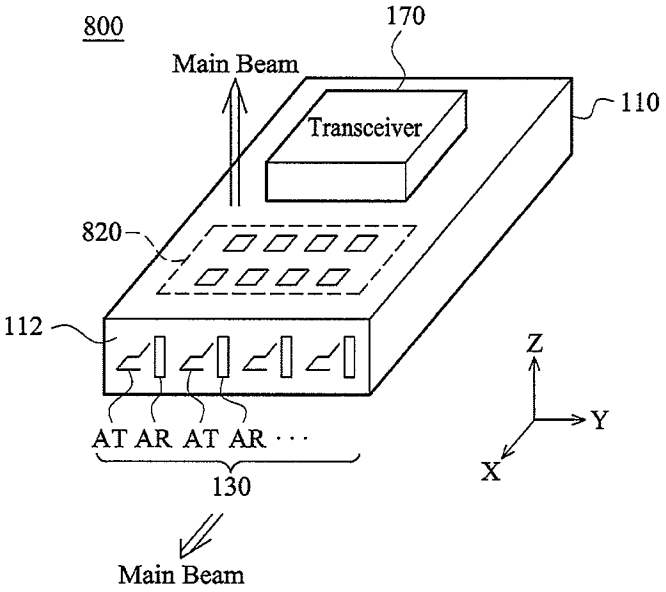
FIG. 8 is a pictorial drawing for illustrating a mobile device according to another embodiment of the invention.

FIG. 8 is a pictorial drawing for illustrating a mobile device 800 according to another embodiment of the invention. As shown in FIG. 8, the mobile device 800 further comprises another antenna array 820 which is disposed on a surface of the dielectric substrate 110 and is electrically coupled to the transceiver 170. In the embodiment, the main beam of the antenna array 130 is substantially toward the X-direction, and a main beam of the antenna array 820 is substantially toward a Z-direction perpendicular to the X-direction. Similarly, the antenna array 820 may comprise one or more transmission antennas or reception antennas, such as patch antennas.

As to element parameters, in an embodiment, the dielectric substrate 110 is an LTCC substrate. The dielectric substrate 110 has a thickness of about 1.45 mm and has a dielectric constant of about 7.5. The foregoing parameters can be adjusted according to desired frequency bands.

The embodiments of FIGS. 1-8 have the following advantages: (1) The antenna array is embedded in the dielectric substrate such that occupied area is decreased; (2) The transmission antennas are interleaved with the reception antennas in the antenna array to reduce mutual coupling and to decrease the total length of the antenna array; (3) The antenna array is close to a lateral edge of the dielectric substrate so as to generate end-fire radiation in a horizontal direction; and (4) The main beam of the antenna array is easily tunable.

Figure 9A:
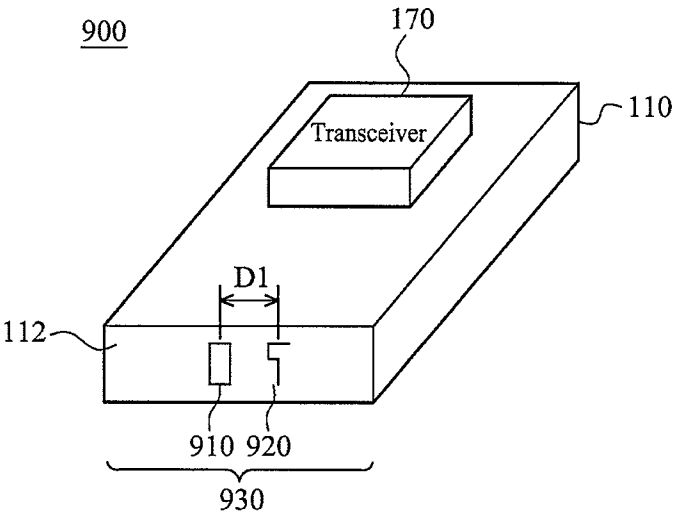
FIG. 9A is a pictorial drawing for illustrating a mobile device according to an embodiment of the invention.

FIG. 9A is a pictorial drawing for illustrating a mobile device 900 according to an embodiment of the invention. The mobile device 900 may be a smart phone, a tablet, or a notebook. As shown in FIG. 9A, the mobile device 900 at least comprises a dielectric substrate 110, an antenna array 930, and a transceiver 170. The mobile device 900 may further comprise a processor, a display module, a touch module, an input module, or other electronic components (not shown). In some embodiments, the dielectric substrate 110 is an FR4 substrate or an LTCC (Low Temperature Co-fired Ceramics) substrate, and the transceiver 170 is a TR (Transmission and Reception) chip. In the embodiment, the transceiver 170 is disposed on the dielectric substrate 110, but it is not limited thereto. The transceiver 170 may be electrically coupled to the antenna array 930, and configured to transmit or receive a signal.

The antenna array 930 is close to a lateral edge 112 of the dielectric substrate 110 so as to generate end-fire radiation. The antenna array 930 at least comprises two antennas 910 and 920. The antennas 910 and 920 are both embedded in the dielectric substrate 110. The difference from the embodiments of FIGS. 1-8 is that all of the antennas of the antenna array 930 are configured as either transmission antennas or reception antennas at a same time. The antennas 910 and 920 may have different polarizations. In some embodiments, the antenna 910 substantially has a horizontal polarization, and the antenna 920 substantially has a vertical polarization. In some embodiments, the antenna 910 substantially has a vertical polarization, and the antenna 920 substantially has a horizontal polarization. The distance D1 between the antennas 910 and 920 is approximately a half wavelength ($\lambda/2$) of a central operating frequency of the antenna array 930. The antenna array 930 is capable of covering an array band which is approximately from 57 GHz to 66 GHz. Accordingly, the mobile device 900 supports the wireless communication standard of the IEEE (Institute of Electrical and Electronics Engineers) 802.11ad.

In some embodiments, the antenna 910 is the slot antenna 300 as shown in FIGS. 3A and 3B, and the antenna 920 is the monopole antenna 500 as shown in FIGS. 5A and 5B. Note that the monopole antenna 500 may be further rotated by 90 degrees to generate a polarization which is substantially perpendicular to a polarization of the slot antenna 300. In other embodiments, any of the antennas 910 and 920 may be other type of antennas, such as an aperture antenna, a dipole antenna, or a Yagi antenna.

Figure 9B:
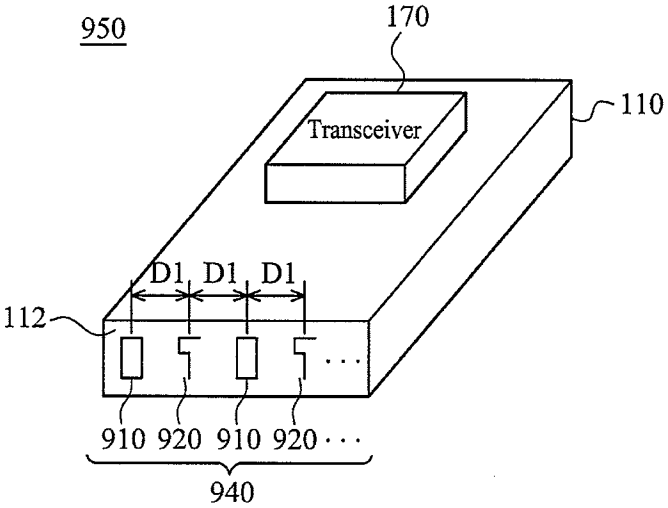
FIG. 9B is a pictorial drawing for illustrating a mobile device according to an embodiment of the invention.

FIG. 9B is a pictorial drawing for illustrating a mobile device 950 according to an embodiment of the invention. FIG. 9B is similar to FIG. 9A. The difference is that an antenna array 940 of the mobile device 950 further comprises three or more antennas 910 and 920. Any two adjacent antennas 910 and 920 have different polarizations. In some embodiments, the antennas 910 substantially have horizontal polarizations, and the antennas 920 substantially have vertical polarizations. In some embodiments, the antennas 910 substantially have vertical polarizations, and the antennas 920 substantially have horizontal polarizations. In addition, the distance D1 between any two adjacent antennas 910 and 920 is approximately a half wavelength ($\lambda/2$) of a central operating frequency of the antenna array 940. Other features of the mobile device 950 of FIG. 9B are similar to those of the mobile device 900 of FIG. 9A. Accordingly, the two embodiments can achieve similar performances.

Figure 10A:
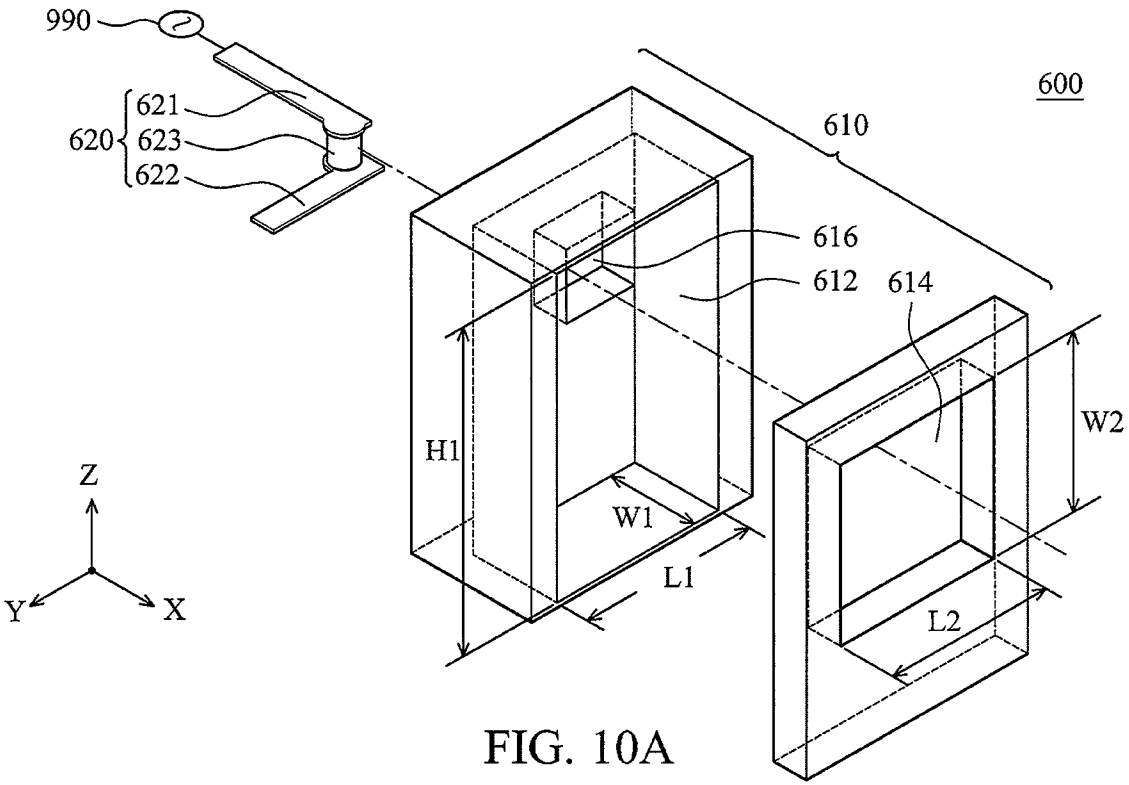
FIG. 10A is an exploded view for illustrating an aperture antenna according to an embodiment of the invention.
Figure 10B:
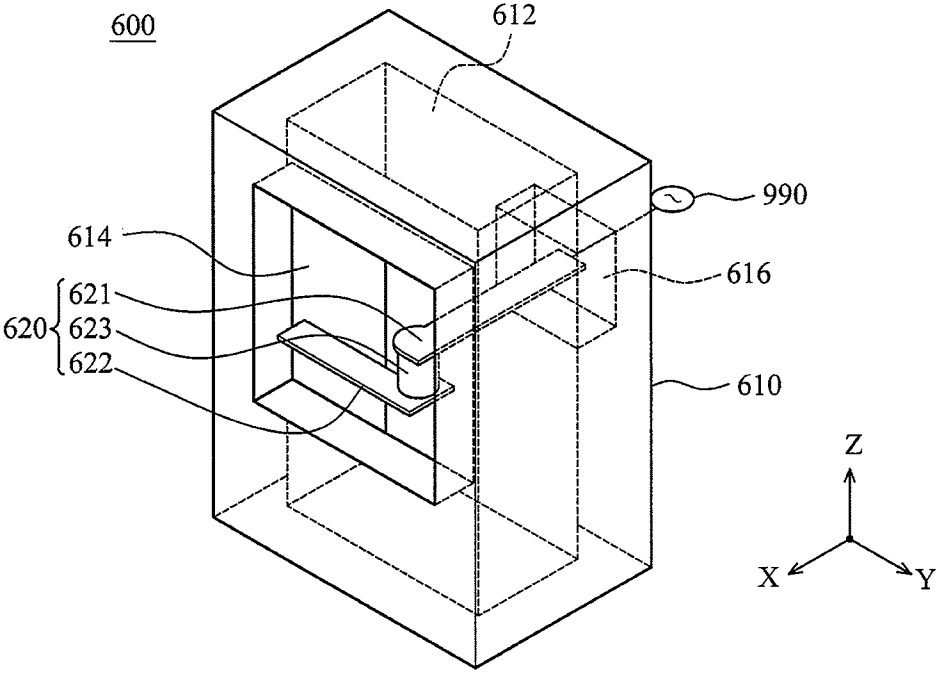
FIG. 10B is a pictorial drawing for illustrating an aperture antenna according to an embodiment of the invention.
Figure 10C:
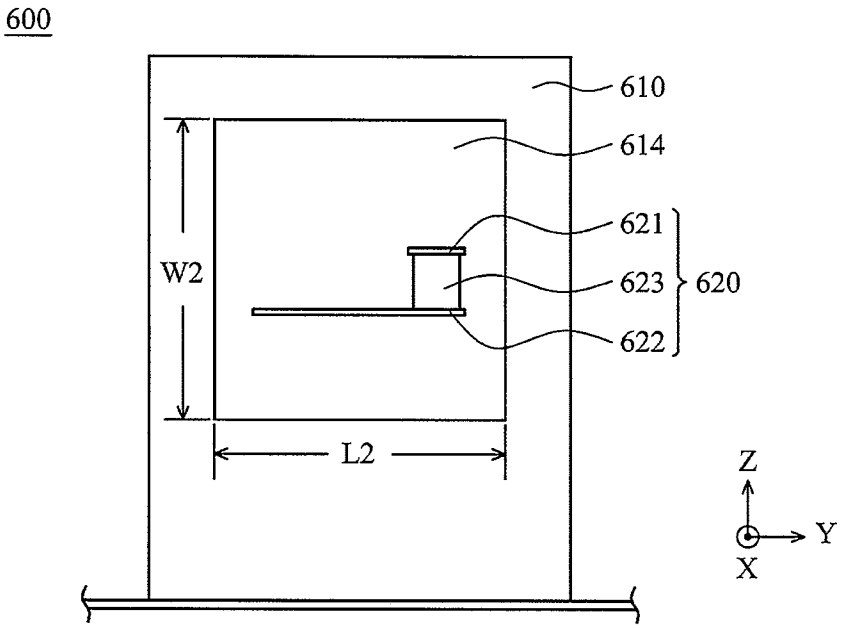
FIG. 10C is a side view for illustrating an aperture antenna according to an embodiment of the invention.
Figure 10D:
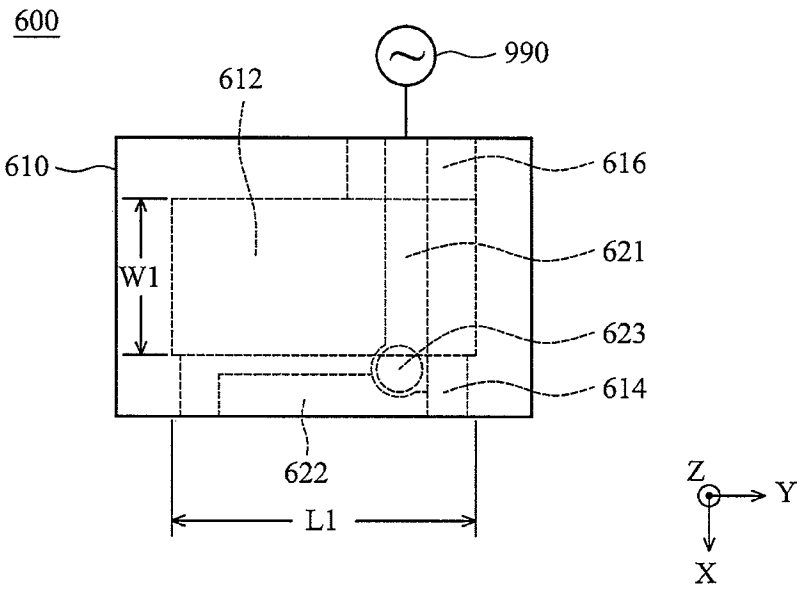
FIG. 10D is a top view for illustrating an aperture antenna according to an embodiment of the invention.

FIG. 10A is an exploded view for illustrating an aperture antenna 600 according to an embodiment of the invention. FIG. 10B is a pictorial drawing for illustrating the aperture antenna 600 according to an embodiment of the invention. FIG. 10C is a side view for illustrating the aperture antenna 600 according to an embodiment of the invention. FIG. 10D is a top view for illustrating the aperture antenna 600 according to an embodiment of the invention. Any of the antennas 910 and 920 in the above embodiments may be the aperture antenna 600. Refer to FIGS. 10A, 10B, 10C, and 10D together. The aperture antenna 600 comprises a cavity structure 610 and a feeding element 620. The cavity structure 610 and the feeding element 620 may be made of metal, such as aluminum or copper. In a preferred embodiment, the dielectric substrate 110 is an LTCC substrate which comprises a plurality of metal layers and a plurality of vias. The plurality of vias are electrically coupled between the plurality of metal layers (similar to the structure as shown in FIGS. 3A and 3B). The cavity structure 610 and the feeding element 620 may be formed by some of the plurality of metal layers and some of the plurality of vias although the plurality of metal layers and the plurality of vias are not shown in FIGS. 10A, 10B, 10C, and 10D. In order to avoid leakage waves, the distance between any two adjacent vias should be smaller than 0.125 wavelength ($\lambda/8$) of a central operating frequency of the antenna array 930.

The cavity structure 610 has a central hollow portion 612, a main aperture 614, and a feeding hole 616. The main aperture 614 and the feeding hole 616 are both connected to the central hollow portion 612. The feeding hole 616 and the main aperture 614 may be respectively formed on two opposite side walls or two adjacent side walls of the cavity structure 610. The main aperture 614 of the cavity structure 610 may be larger than the feeding hole 616 of the cavity structure 610. In some embodiments, the central hollow portion 612 of the cavity structure 610 substantially has a cuboid shape, and the main aperture 614 of the cavity structure 610 substantially has a rectangular shape, and the feeding hole 616 of the cavity structure 610 substantially has a small rectangular shape. In other embodiments, the central hollow portion 612 of the cavity structure 610 has other shapes, such as a cylindrical shape or a cube shape. The cavity structure 610 is configured to reflect electromagnetic waves to enhance the gain of the aperture antenna 600.

The feeding element 620 is coupled to a signal source 990, and extends into the main aperture 614 of the cavity structure 610 to excite the aperture antenna 600. More particularly, the feeding element 620 comprises two feeding branches 621 and 622 and a connection via 623. Each of the feeding branches 621 and 622 may substantially have a straight-line shape. The connection via 623 is electrically coupled between an end of the feeding branch 621 and an end of the feeding branch 622. The feeding branches 621 and 622 substantially form an L-shape. The feeding branch 621 is electrically coupled to the signal source 990, and extends through the feeding hole 616 of the cavity structure 610 into the central hollow portion 612 of the cavity structure 610. The feeding branch 622 is electrically coupled through the connection via 623 to the feeding branch 621. In some embodiments, at least a portion of the area of the feeding branch 622 overlaps with the main aperture 614 in a normal direction of a plane (e.g., an XY plane). In other words, at least a portion of the feeding branch 622 is disposed within the main aperture 614 of the cavity structure 610. In a preferred embodiment, the feeding branch 622 is completely disposed within the main aperture 614. It should be understood that the invention is not limited to the above. In other embodiments, the feeding element 620 has a non-transition structure, such as a straight-line shape, and the connection via 623 may be removed such that the feeding branch 621 is directly electrically coupled to the feeding branch 622.

Figure 11:
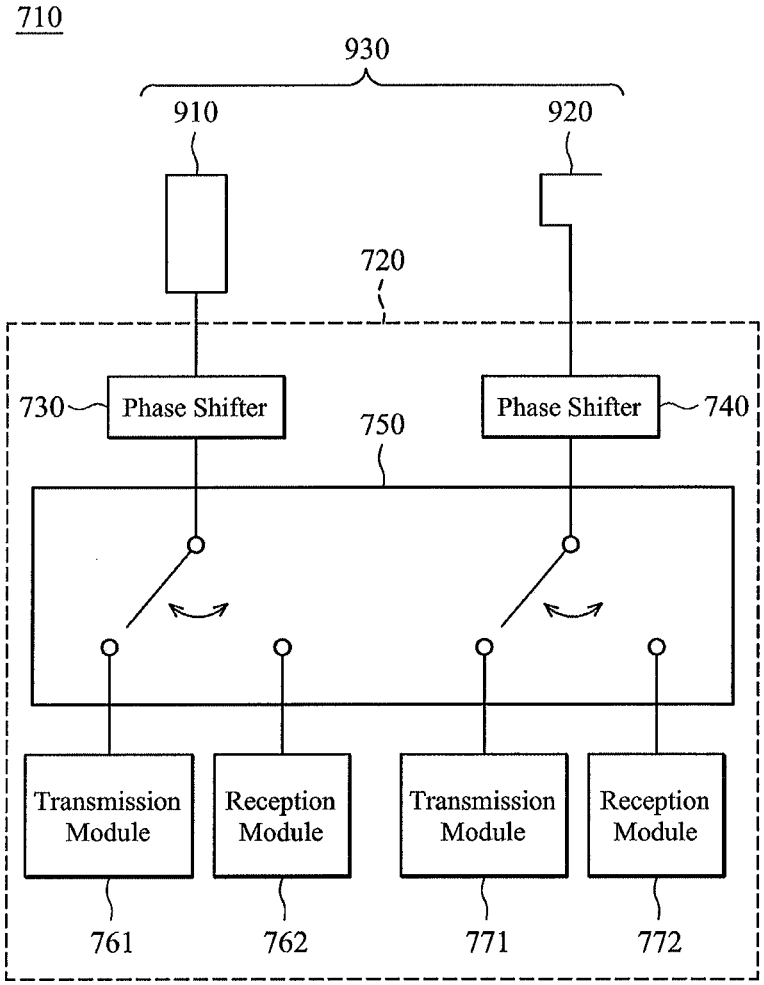
FIG. 11 is a diagram for illustrating a mobile device according to an embodiment of the invention.

FIG. 11 is a diagram for illustrating a mobile device 710 according to an embodiment of the invention. The mobile device 710 comprises a dielectric substrate (not shown), an antenna array 930, and a transceiver 720. Similarly, antennas 910 and 920 of the antenna array 930 are embedded in the dielectric substrate, and the antenna array 930 is close to a lateral edge of the dielectric substrate so as to generate end-fire radiation. The transceiver 720 at least comprises phase shifters 730 and 740, a TR (Transmission and Reception) switch 750, transmission modules 761 and 771, and reception modules 762 and 772. The transceiver 720 and all components therein may be controlled according to a processor control signal or a user input signal. The TR switch 750 is configured to exchange functions of transmission antennas and reception antennas. For example, if the TR switch 750 is switched to the transmission modules 761 and 771, the antennas 910 and 920 may be configured as transmission antennas at a same time, and if the TR switch 750 is switched to the reception modules 762 and 772, the antennas 910 and 920 may be configured as reception antennas at a same time. The phase shifters 730 and 740 are configured to control a phase difference between the antennas 910 and 920. For example, it is assumed that the antenna 910 substantially has a horizontal polarization and the antenna 920 substantially has a vertical polarization. If the phase difference between the antennas 910 and 920 is equal to 0 degree, the antenna array 930 will have a linear polarization with +45 degrees. If the phase difference between the antennas 910 and 920 is equal to 180 degrees, the antenna array 930 will have a linear polarization with −45 degrees. If the phase difference between the antennas 910 and 920 is equal to −90 or +90 degrees, the antenna array 930 will be RHCP (Right Hand Circularly Polarized) or LHCP (Left Hand Circularly Polarized). In addition, if the transmission module 761 and the reception module 762 are turned off, the antenna array 930 will have a vertical polarization, and if the transmission module 771 and the reception module 772 are turned off, the antenna array 930 will have a horizontal polarization. To be brief, the overall polarization of the antenna array 930 is dynamically adjusted by controlling the phase difference between the antennas 910 and 920 according to free movement and rotation of the mobile device. Accordingly, the antenna array 930 may have a horizontal polarization, a vertical polarization, a circular polarization, or a specific polarization with a specific angle, and the mobile device comprising the antenna array 930 can receive or transmit signals in difference directions easily. Furthermore, since the mobile device can have a variety of polarizations dynamically, signal transmission between devices can be smooth and continuous, regardless of polarizations of the reception devices. Other features of the mobile device 710 of FIG. 11 are similar to those of the mobile device 900 of FIG. 9A. Accordingly, the two embodiments can achieve similar performances.

Refer to FIGS. 10A, 10B, 10C, and 10D again. In some embodiments, the size and parameters of the elements of the invention are as follows. The thickness of the dielectric substrate 110 is approximately equal to 1.45 mm, and the dielectric constant of the dielectric 110 is approximately from 7.5 to 7.8. The length L1 of the central hollow portion 612 is approximately from 632 μm to 948 μm, and is preferably equal to 790 μm. The width W1 of the central hollow portion 612 is approximately from 296 μm to 444 μm, and is preferably equal to 370 μm. The height H1 of the central hollow portion 612 is approximately from 1027 μm to 1541 μm, and is preferably equal to 1284 μm. The length L2 of the main aperture 614 is approximately from 632 μm to 948 μm, and is preferably equal to 790 μm. The width W2 of the main aperture 614 is approximately from 578 μm to 868 μm, and is preferably equal to 723 μm. The total length of the feeding element 620 (including the feeding branches 621 and 622 and the connection via 623) is approximately from 1120 μm to 1680 μm, and is preferably equal to 1400 μm. The antenna array of the invention has a total peak gain of about 8.5 dBi in the array band from 57 GHz to 66 GHz, and meets practical application requirements.

The embodiments of FIGS. 9-11 have the following advantages: (1) The antenna array is embedded in the dielectric substrate of the mobile device such that occupied area is decreased; (2) The antenna array is close to a lateral edge of the dielectric substrate so as to generate end-fire radiation; (3) The aperture antenna of the antenna array has wide bandwidth; (4) The total polarization of the antenna array is easily adjustable and capable of receiving and transmitting signals in different directions; and (5) The mobile device comprising the antenna array can maintain good radiation performance even if it is moved and rotated freely.

Note that the above sizes, shapes, and parameters of the elements, and frequency ranges are not limitations of the invention. A designer may make adjustments according to different requirements.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

The embodiments of the disclosure are considered as exemplary only, not limitations. It will be apparent to those skilled in the art that various modifications and variations can be made on the invention. The true scope of the disclosed embodiments is indicated by the following claims and their equivalents.

What is claimed is:

1. A mobile device, at least comprising:

a dielectric substrate;

an antenna array, at least comprising:

a first antenna, embedded in the dielectric substrate; and a second antenna, embedded in the dielectric substrate, wherein the first antenna and the second antenna have different polarizations; and a transceiver, coupled to the antenna array, and configured to transmit or receive a signal, wherein the first antenna and the second antenna transmit or receive the same frequency band to form a synthetic beam, and wherein the synthetic beam is formed by switching and adjusting the transceiver, and further by altering input phase and input energy of the first antenna and the second antenna so as to dynamically adjust a main beam of the antenna array.

2. The mobile device as claimed in claim 1, wherein the dielectric substrate is an LTCC (Low Temperature Co-fired Ceramics) substrate or an FR4 substrate.

3. The mobile device as claimed in claim 1, wherein a distance between the first antenna and the second antenna is approximately a half wavelength of a central operating frequency of the antenna array.

4. The mobile device as claimed in claim 1, wherein a polarization of the first antenna is perpendicular to that of the second antenna.

5. The mobile device as claimed in claim 1, wherein the first antenna or the second antenna is an aperture antenna.

6. The mobile device as claimed in claim 5, wherein the aperture antenna comprises:

a cavity structure, having a central hollow portion, a main aperture, and a feeding hole, wherein the main aperture and the feeding hole are both connected to the central hollow portion; and a feeding element, coupled to a signal source, and extending into the main aperture of the cavity structure.

7. The mobile device as claimed in claim 6, wherein the feeding element comprises:

a first feeding branch, coupled to the signal source, and extending through the feeding hole of the cavity structure into the central hollow portion of the cavity structure; and a second feeding branch, coupled to the first feeding branch, wherein at least a portion of the second feeding branch is disposed in the main aperture of the cavity structure.

8. The mobile device as claimed in claim 7, wherein the first feeding branch and the second feeding branch substantially form an L-shape.

9. The mobile device as claimed in claim 7, wherein the feeding element further comprises:

a connection via, coupled between an end of the first feeding branch and an end of the second feeding branch.

10. The mobile device as claimed in claim 6, wherein the feeding hole and the main aperture are respectively formed on two opposite side walls of the cavity structure.

11. The mobile device as claimed in claim 6, wherein the main aperture of the cavity structure is larger than the feeding hole of the cavity structure.

12. The mobile device as claimed in claim 6, wherein the main aperture of the cavity structure substantially has a rectangular shape.

13. The mobile device as claimed in claim 6, wherein the dielectric substrate comprises a plurality of metal layers and a plurality of vias, and the cavity structure is formed by the plurality of metal layers and the plurality of vias.

14. The mobile device as claimed in claim 1, wherein an overall polarization of the antenna array is dynamically adjusted by controlling a phase difference between the first antenna and the second antenna.

* * * * *